US006145317A

United States Patent [19]

Gobrecht et al.

[11] Patent Number: 6,145,317

[45] Date of Patent: Nov. 14, 2000

[54] STEAM TURBINE, STEAM TURBINE PLANT AND METHOD FOR COOLING A STEAM TURBINE

[75] Inventors: Edwin Gobrecht, Ratingen; Michael Wechsung, Mülheim an der Ruhr, both of Germany

[73] Assignee: Siemens Aktiengesellschaft, Munich, Germany

[21] Appl. No.: 09/277,278

[22] Filed: Mar. 26, 1999

Related U.S. Application Data

[63] Continuation of application No. PCT/DE97/02058, Sep. 12, 1997.

[30] Foreign Application Priority Data

Sep. 26, 1996 [DE] Germany ..... 196 39 714

[51] Int. Cl.[7] ..... F01K 13/00

[52] U.S. Cl. ..... 60/677; 415/116

[58] Field of Search ..... 60/650, 682, 677; 415/116–122.1

[56] References Cited

U.S. PATENT DOCUMENTS

| | | | |
|---|---|---|---|
| 2,438,998 | 4/1948 | Halford | 415/122.1 X |
| 2,874,537 | 2/1959 | Scarborough et al. | 415/116 X |
| 3,173,654 | 3/1965 | Roe . | |

FOREIGN PATENT DOCUMENTS

| | | |
|---|---|---|
| 2 215 530 | 8/1974 | France . |
| 324 402 | 8/1920 | Germany . |
| 195 47 803 C1 | 4/1997 | Germany . |

OTHER PUBLICATIONS

Patent Abstracts of Japan No. 58–220907 (Tsugio), dated Dec. 22, 1983.

Patent Abstracts of Japan No. 02–081905 (Akihisa), dated Mar. 22, 1990.

Patent Abstracts of Japan No. 08–218811 (Masaki), dated Aug. 27, 1996.

*Primary Examiner*—Hoang Nguyen

*Attorney, Agent, or Firm*—Herbert L. Lerner; Laurence A. Greenberg; Werner H. Stemer

[57] ABSTRACT

A steam turbine with a steam inlet region, an exhaust-steam region and a blading region surrounded by a turbine housing and disposed axially therebetween. Furthermore, a cooling-fluid inlet is provided which can be closed and opened by a closing member and through which cooling fluid can be introduced into the turbine housing. The introduced cooling fluid can be conducted out of the turbine housing again via a suction device for sucking out the cooling fluid. The invention relates, furthermore, to a steam turbine plant and to a method for cooling the steam turbine.

12 Claims, 1 Drawing Sheet

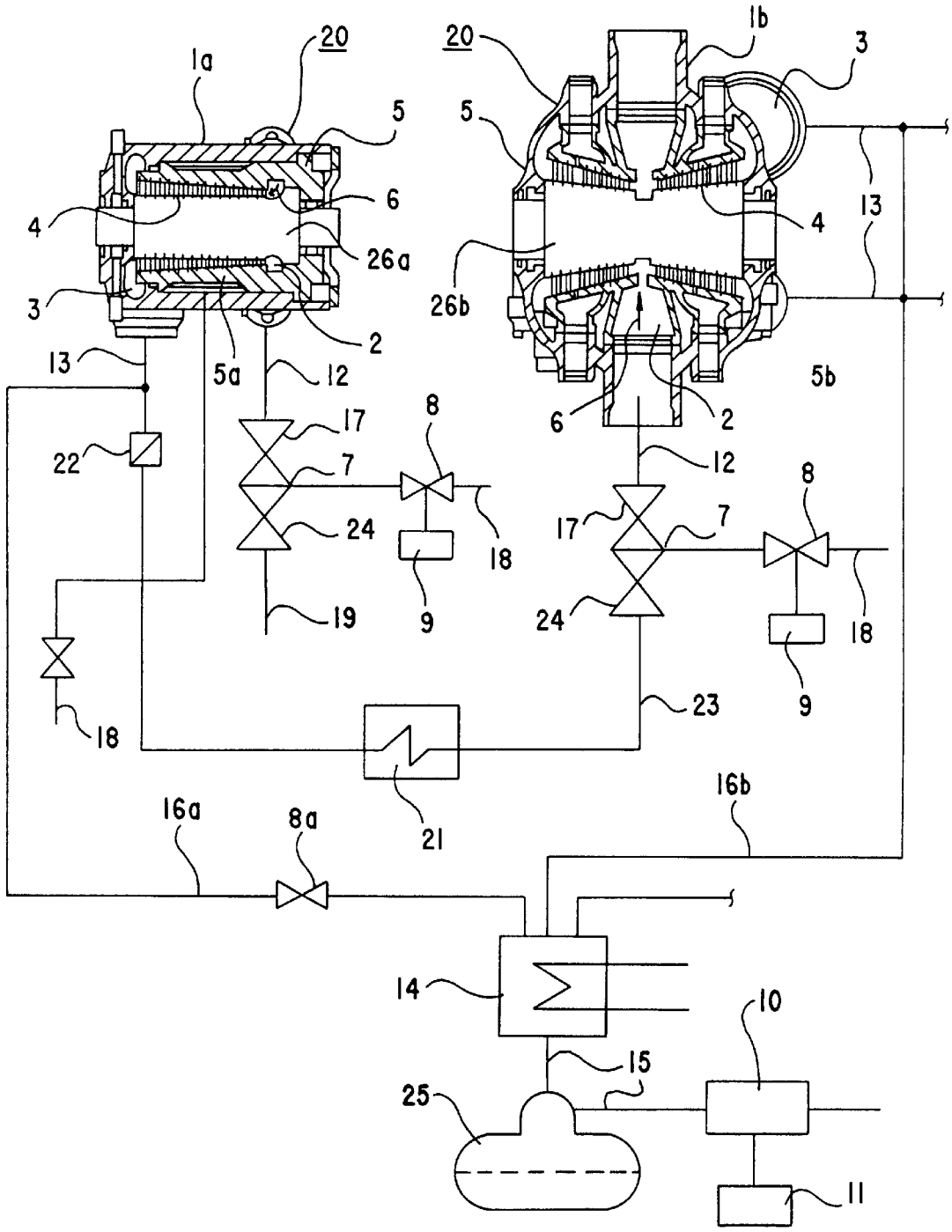
1a
20
5
6
4
26a
3
2
5a
13
12
22
17
7
24
8
18
9
19
18
1b
20
3
5
4
13
26b
6
2
5b
12
17
7
24
8
18
9
23
21
16a
8a
16b
14
15
10
25
11

STEAM TURBINE, STEAM TURBINE PLANT AND METHOD FOR COOLING A STEAM TURBINE

CROSS-REFERENCE TO RELATED APPLICATION

This application is a continuation of copending International Application No. PCT/DE97/02058, filed Sep. 12, 1997, which designated the United States.

BACKGROUND OF THE INVENTION

Field of the Invention

The invention relates to a steam turbine with a steam inlet region, an exhaust-steam region and a blading region surrounded by a turbine housing and disposed axially therebetween. The invention relates furthermore, to a method for cooling a steam turbine having a turbine housing.

A method and device for cooling an idly running steam or gas turbine are described in German Patent 324 204. For carrying out the cooling, an ejector connected to the steam flow conduit via a valve is specified. By the ejector, steam is sucked away through the inflow conduit in the opposite direction to the normal direction of flow. The steam sucked away may be tapped or exhaust steam from a further turbine as well as wet or saturated fresh steam.

U.S. Pat. No. 3,173,654 relates to a steam turbine with a high-pressure part turbine and a double-flow low-pressure part turbine that is run in the stand-by mode. To avoid overheating the turbine blades, there is provided a cooling system, via which-water under high pressure is injected out of the condenser into the part turbine by a multiplicity of conduits both in the low-pressure part turbine and in the high-pressure part turbine. The water evaporates completely and, since the vacuum pumps are in operation, is returned into the condenser again. The quantity of injected water is regulated as a function of the temperature in the part turbines, for each injection conduit, separately in each case, via a corresponding valve.

Patent Abstracts of Japan, Vol. 008, No. 073 (N-287) of Japanese Patent Application No. 58-220907 describes a steam turbine plant with a low-pressure part turbine, a high-pressure part turbine and a medium-pressure part turbine. A condenser is connected to the low-pressure part turbine. The exhaust-steam conduit of the high-pressure and low-pressure part turbine is connected to a vacuum pump in order to avoid thermal tensions and thermal expansions during cooling. Air is forced through the high-pressure and medium-pressure part turbine via the pump opposite to the flow direction of the action steam, which, in normal operation of the turbine, flows through it. The air comes, in the case of the high-pressure part turbine, directly from the condenser and in the case of the medium-pressure part turbine, it also comes indirectly via the low-pressure part turbine from the condenser. Air enters the condenser via a vacuum breaker. The air inlet therefore lies at the end of the flow path of the action steam far downstream of the high-pressure and medium-pressure part turbine, namely in the condenser of the low-pressure part turbine.

The two publications mentioned above therefore relate in each case to the cooling of steam turbines running idly or running in the stand-by mode. In these instances, cooling takes place solely via steam which either is supplied directly or occurs as a result of evaporating water. The above two publications therefore relate to a steam turbine in a state in which externally generated heat is discharged, the heat occurring as a result of friction in a turbine running at an operating rotational speed, of, for example, 3000 revolutions per minute. If the heat were not discharged, the temperature in the steam turbine would be well above the operating temperature.

In a steam turbine, particularly a high-pressure turbine or a medium-pressure turbine with preceding intermediate superheating, temperatures of up to and above 500° C. occur during operation in the power mode. In the course of operation in the power mode, for example under full load, which may last a few weeks or months, the turbine housing as well as the turbine rotor and other turbine components, such as the fresh-steam valve, quick-closing valve, turbine blade, etc., are heated to a high temperature. After the steam turbine plant as a whole has been shut down, the turbine rotor of each turbine can continue to be rotated at a reduced rotational speed for a predetermined period by a rotation device and the steam atmosphere can be evacuated via an evacuation device. So that maintenance or checking work and, if appropriate, retrofitting work can be carried out as soon as possible after the steam turbine has been shut down, it may be desirable, under certain circumstances, to cool the steam turbine as quickly as possible. While at the same time adhering to predetermined limits for differences in expansion which occur between the turbine rotor and, for example, the turbine housing.

SUMMARY OF THE INVENTION

It is accordingly an object of the invention to provide a steam turbine, a steam turbine plant and a method for cooling the steam turbine, that overcome the above-mentioned disadvantages of the prior art devices and methods of this general type, which can be cooled rapidly by forced cooling.

With the foregoing and other objects in view there is provided, in accordance with the invention, a steam turbine, including: a steam inlet region; an exhaust-steam region; a blading region disposed axially between the steam inlet region and the exhaust-steam region; a turbine housing surrounding the blading region; a suction device having a suction capacity for sucking cooling fluid out of the turbine housing; at least one cooling-fluid inlet disposed upstream of the exhaust-steam region in regards to a flow direction of action steam flowing through the turbine housing during a normal operating mode, the at least one cooling-fluid inlet introducing the cooling fluid into the turbine housing for cooling down a temperature during a shutdown mode of operation; and a closing member for opening and closing the at least one cooling-fluid inlet.

According to the inventions, the object is achieved in that the turbine housing can be connected to a cooling-fluid inlet for the inflow of cooling fluid, the cooling-fluid inlet being capable of being closed and opened by a closing member and is disposed upstream of the exhaust steam region. A suction device is provided for sucking away cooling fluid out of the turbine housing. The cooling-fluid inlet is preferably closed during the normal operation of the steam turbine in a power mode, during which action steam enters the turbine in a steam inlet region, flows through a blading region with the effect of driving the turbine shaft and flows out of the steam turbine from an exhaust steam region. During operation in the power mode, therefore, no cooling fluid passes into the steam turbine. After the steam turbine has been shut down, action steam then no longer flows through the steam turbine, the cooling-fluid inlet is opened by the closing member, so that cooling fluid, particularly air, flows out of the air atmosphere surrounding the steam turbine into the steam turbine. The inflowing cooling fluid is sucked out of the turbine housing via a suction device, for example an evacuation device, which generates a vacuum. It thereby becomes possible to cool the steam turbine (housing and shaft) rapidly to below 200° C., in particular 150° C. to 180° C., in less than 40 hours, preferably in about 24 hours. The cooling-fluid inlet is preferably a separate orifice, for example an air inlet port on the turbine, with a flow cross-section which is dimensioned in such a way that cooling fluid sufficient for rapid cooling passes into the turbine. A plurality of cooling-fluid inlets may also be provided.

The closing member may be an openable dummy flange, a valve or the like. The closing member may, for example, be opened automatically, for example in a motor driven manner, via a first control unit. A closing member to be opened manually could also be used.

The suction device, for example an evacuation assembly that serves for generating a vacuum in a condenser, is preferably connected to a control unit for controlling its suction capacity. Moreover, the control unit may serve for automatically opening a flow connection between the suction device and the turbine housing.

Preferably, in the case of a high-pressure steam turbine, a flow connection between the turbine housing and the suction device is prevented during normal operation in the power mode.

The cooling-fluid inlet is preferably connected to a steam feed opening into the steam inlet region. The cooling-fluid inlet is preferably connected to an adjusting valve for regulating the fresh-steam quantity, as a result of which it likewise becomes possible to cool the adjusting valve after the power mode operation of the steam turbine has ended.

The suction device is preferably connected to an outflow conduit opening into the exhaust-steam region. In this case, the outflow conduit may be shut off during the cooling operation by a non-return flap, so that the entire quantity of cooling fluid flowing through the steam turbine is conducted through the suction device. The suction device is preferably flow-connected to a condenser, in particular the steam region of a condensate container. It is thus possible, as a suction device, for an evacuation unit already employed during operation in the power mode to be used also for cooling the steam turbine and further steam turbine components after shutdown, such as the adjusting valve, quick-closing valve, etc. Such an evacuation unit could, for example, serve for evacuating the steam space in the condensate container or for evacuating the steam atmosphere in the steam turbine after the power mode operation has ended.

The object directed at a steam turbine plant having a high-pressure part turbine and at least one medium-pressure part turbine is achieved in that the turbine housings of the part turbines are in each case connected to a cooling-fluid inlet and a suction device is provided. The suction device is connected to the condenser via a suction conduit and to the part turbines via a connecting conduit in each case and the cooling fluid inlets are in each case disposed upstream of the respective exhaust steam region. After the steam turbine plant has been shut down, cooling of each part turbine takes place in that cooling fluid, in particular air, flows into the housing of the respective part turbine via the respective cooling-fluid inlet and is sucked away out of the part turbine by the suction device which is connected both to the part turbine and to the condenser. The suction device preferably generates a vacuum that brings about a flow of the cooling fluid, air, through the part turbines and corresponding components, such as the adjusting valves and the quick-closing valves. The air absorbs heat in each part turbine, with the result that the part turbine is cooled. In this case, the suction device may be an evacuation assembly that is already employed for evacuating the steam atmosphere in each part turbine immediately after the steam turbine plant has been shut down. It is thus possible for the part turbines of the steam turbine plant to be cooled without additional assemblies, for example a compressed-air reservoir or compressed-air pump, there simply being the necessity to provide at desired points cooling-fluid inlets with a respective shut-off member and a limited number of conduits for conducting the cooling fluid.

The object directed at a method for cooling the steam turbine having the turbine housing is achieved in that, after shutdown, a cooling-fluid inlet is flow-connected to the turbine housing. Then cooling fluid, in particular air, flowing in through the cooling-fluid inlet is conducted, while at the same time absorbing heat, through the turbine housing by the suction device. With this type of forced cooling of the steam turbine, cooling occurs and amounts to several 100° C. in one day, while at the same time adhering to predeterminable limits for the differences in expansion between the turbine rotor and turbine housing, in particular the turbine inner housing. As a result, maintenance, repair or retrofitting work may be carried out on the steam turbine as early as one day after shutdown. After shutdown, the turbine is rotated at a low rotational speed of about 50 revolutions per minute (rotor-turning mode), in particular via a drive motor. Virtually no additional heat is generated thereby.

After shutdown, the turbine is in a rotor-turning mode, existing evacuation assemblies remaining in operation. Air inlets, in particular air inlet ports, are opened on the high-pressure turbine and a medium-pressure turbine. On the high-pressure turbine, fresh-steam ports and a connecting conduit between the exhaust-steam port of the high-pressure turbine and a condenser may be opened. The condenser is connected to the evacuating assemblies, so that air sucked in through the air inlet ports is sucked through the turbine blading and, via the connecting conduit, into the condenser. This causes the high-pressure turbine to be cooled. Ports may likewise be opened in the region of the steam inlet on the medium-pressure turbine. The air flowing in through the ports can be sucked through the evacuation assemblies, via the medium-pressure blading and, if appropriate, a low-pressure turbine located downstream in flow terms, into the condenser. In this case, in particular, the medium-pressure shaft and the medium-pressure inner housing and/or medium-pressure outer housing, the medium-pressure blading, the adjusting valve and the quick-closing valve of the medium-pressure turbine are cooled. It is also possible for the air to be conducted into the condenser via a corresponding connecting conduit from the exhaust-steam region of the medium-pressure turbine, by passing a low-pressure turbine located downstream. The high-pressure turbine and the medium-pressure turbine are preferably cooled to a temperature of below 150° C. The cooling operation can be checked with the aid of temperature measurement values that are determined within the steam turbine, for example by temperature measuring points already provided for operation in the power mode. Depending on how cooling progresses, the cooling operation may be accelerated or slowed via the suction capacity of the suction device. The cooling operation is carried out in such a way that predetermined maximum differences in expansion, in particular between the turbine rotor and the inner housing and/or outer housing of the steam turbine, are not exceeded. By supplying the cooling fluid via different air inlets, it is possible, for example, to delay the cooling of the turbine rotor of a high-pressure part turbine and accelerate the cooling of the high-pressure housing.

A steam turbine and a rapid-cooling system, without additional assemblies, for cooling the steam turbine are explained in more detail with reference to the exemplary embodiment illustrated in the single FIGURE.

Other features which are considered as characteristic for the invention are set forth in the appended claims.

Although the invention is illustrated and described herein as embodied in a steam turbine, a steam turbine plant and a method for cooling the steam turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is a diagrammatic block diagram of a steam turbine plant with a high-pressure part turbine and a medium-pressure part turbine in longitudinal section that is not true to scale.

DESCRIPTION OF THE PREFERRED EMBODIMENTS

Referring now to the single FIGURE of the drawing in detail, there is shown a steam turbine plant 20 having a high-pressure part turbine la with a steam inlet region 2, an exhaust-steam region 3 and a blading region 4 located axially therebetween. A steam feed 12, namely a fresh-steam conduit 19, in which a quick-closing valve 24 and an adjusting valve 17 are disposed as a combination valve, opens into the steam inlet region 2. The adjusting valve 17 has a cooling-fluid inlet 7, into which an air conduit 18 opens. Disposed in the air conduit 18 is a closing member 8, in particular a valve, which is connected to a first control unit 9. It becomes possible for the closing member 8 to be opened and closed via the first control unit 9, so that the cooling-fluid inlet 7 can be opened for an inflow of cooling fluid 6, in particular air, and can be closed. During a normal power operating mode of the steam turbine 1, the high-pressure part turbine la is closed via the closing member 8, and during a rapid-cooling mode the closing member is opened, so that, during the latter, cooling fluid 6 can flow into the adjusting valve 17.

A turbine rotor 26*a* is disposed within a high-pressure housing 5*a* which includes an inner and an outer housing not specified in anymore detail. Connected to the exhaust-steam region 3 is an outflow conduit 13 that leads through an intermediate super heater 21 to the steam inlet region 2 of a medium-pressure part turbine 1*b*. A non-return flap 22 is disposed downstream of the exhaust-steam region 3 in the outflow conduit 13. Between the exhaust-steam region 3 and the back flow flap 22, a connecting line 16*a* leading to a condenser 14 opens into the outflow conduits 13. The connecting conduit 16*a* is closed by a closing member 8*a*during the normal operation of the high-pressure part turbine 16 in the power mode. A combination of the adjusting valve 17 and a quick-closing valve 24 is likewise disposed in a medium-pressure feed conduit 23 between the steam inlet region 2 of the medium-pressure part turbine 1*b* and the intermediate super heater 21. As already described above, an air conduit 18 opens into this combination in another cooling-fluid inlet 7. The medium-pressure part turbine 1*b* is of a double-flow configuration and has a medium-pressure housing 5*b* including an inner and an outer housing, not specified in any more detail, in which a turbine rotor 26*b* and another blading region 4 are disposed. During normal operation of the steam turbine plant 20 in the power mode, action steam flows from the intermediate super heater 21 into the steam inlet region 2 of the medium-pressure part turbine 1*b*. The steam is divided into two flows in the blading region 4 and passes out of a respective exhaust-steam region 3 into one or more of the outflow conduits 13 that leads or lead to one or more non-illustrated low-pressure part turbines. A connecting conduit 16*b* leads from the outflow conduits 13 into the condenser 14. A further conduit, not specified in any more detail, likewise leads from the low-pressure part turbine into the condenser 14. It goes without saying that the connecting conduit 16*b* may be dispensed with, so that, during operation in a cooling mode, by use of the adjusting valve 7, the cooling fluid 6 flowing into the medium-pressure part turbine 1*b* passes the non-illustrated low-pressure part turbine into the condenser 14. The condenser 14 is followed by a condensate container 25 which is connected via a suction conduit 15 to a suction device 10, for example an evacuation assembly, a jet pump or the like. The suction capacity of the suction device 10 can be controlled via a second control unit 11, so that, in the cooling operation, the quantity of air sucked in and consequently the cooling rate can be adjusted. Of course, it is also possible to have a configuration in which the suction device 10 is connected directly to the connecting conduits 16*a*, 16*b*, without the cooling fluid 6 being conducted through the condenser 14.

The invention is distinguished by a forced cooling of the steam turbine after operation in the power mode has ended, in which, after shutdown, a cooling-fluid inlet and a suction conduit are opened. Via the suction device 10 connected to the suction conduit 15, air flowing into the steam turbine 20 via the cooling-fluid inlet is conducted out again, while at the same time absorbing heat. The method makes it possible to utilize already existing components of the steam turbine, such as, for example, evacuation assemblies and steam conduits. It is merely necessary, where appropriate, to provide corresponding cooling-fluid inlets (for example, air inlet ports) and branch-offs from existing steam outflow conduits, in order to guarantee a forced air flow through the steam turbine. The method allows rapid cooling, in particular of a high-pressure steam turbine, during which cooling amounting to up to 400 K can be achieved within 24 hours.

We claim:

1. A steam turbine, comprising:

a steam inlet region;

an exhaust-steam region;

a blading region disposed axially between said steam inlet region and said exhaust-steam region;

a turbine housing surrounding said blading region;

a suction device having a suction capacity for sucking cooling fluid out of said turbine housing;

at least one cooling-fluid inlet disposed upstream of said exhaust-steam region in regards to a flow direction of action steam flowing through said turbine housing during a normal operating mode, said at least one cooling-fluid inlet introducing the cooling fluid into said turbine housing for cooling down a temperature during a shutdown mode of operation; and a closing member for opening and closing said at least one cooling-fluid inlet.

2. The steam turbine according to claim 1, including a first control unit connected to said closing member for automatically opening said at least one cooling-fluid inlet.

3. The steam turbine according to claim 1, including:

a flow connection between said suction device and said turbine housing; and a second control unit for controlling said suction capacity of said suction device and for automatically opening said flow connection between said suction device and said turbine housing.

4. The steam turbine according to claim 1, including a steam feed opening into said steam inlet region and connected to said at least one cooling-fluid inlet.

5. The steam turbine according to claim 4, including an adjusting valve connected to said at least one cooling fluid inlet.

6. The steam turbine according to claim 1, including an outflow conduit connected to said suction device and opening into said exhaust-steam region.

7. The steam turbine according to claim 1, including a suction conduit and a condenser flow-connected to said suction device via said suction conduit.

8. The steam turbine according to claim 7, including a connecting conduit and a high-pressure part turbine flow-connected to said condenser via said connecting conduit.

9. The steam turbine according to claim 1, wherein said at least one cooling-fluid inlet is an inlet for air surrounding said turbine housing.

10. A steam turbine plant, comprising:

a high-pressure part turbine having a high-pressure housing and an exhaust-steam region;

a first cooling fluid inlet disposed upstream of said exhaust steam region of said high-pressure part turbine and connected to said high-pressure housing;

a medium-pressure part turbine having a medium-pressure housing and an exhaust-steam region;

a second cooling fluid inlet disposed upstream of said exhaust steam region of said medium-pressure part turbine and connected to said medium-pressure housing;

a condenser;

a suction conduit connected to said condenser;

a first connecting conduit connecting said high-pressure part turbine to said condenser;

a second connecting conduit connecting said medium-pressure part turbine to said condenser; and a suction device connected to said condenser via said suction conduit, to said high-pressure part turbine via said first connecting conduit and to said medium-pressure part turbine via said second connecting conduit, said condenser being flow-disposed between said high-pressure part turbine, said medium-pressure part turbine and said suction device.

11. An improved method for cooling a steam turbine having a turbine housing, the improvement which comprises:

flow-connecting a cooling-fluid inlet to the turbine housing after shutting down the steam turbine; and conducting a cooling fluid flowing in through the cooling-fluid inlet through the turbine housing in a direction of an action steam flowing through the steam turbine in normal operating mode via a suction device, the cooling fluid absorbing and removing heat from the steam turbine.

12. The method according to claim 11, which comprises using air as the cooling fluid.

* * * * *